US005244034A

United States Patent [19]

Yamada et al.

[11] Patent Number: 5,244,034

[45] Date of Patent: Sep. 14, 1993

[54] ELECTROMAGNETIC LEVITATION TYPE CONTINUOUS METAL CASTING

[75] Inventors: Masahiko Yamada; Yuji Harada; Hidemi Shigetoyo, all of Kanagawa, Japan

[73] Assignee: Showa Electric Wire & Cable Co., Ltd., Kanagawa, Japan

[21] Appl. No.: 906,009

[22] Filed: Jun. 26, 1992

Related U.S. Application Data

[63] Continuation of Ser. No. 619,866, Nov. 29, 1990, abandoned.

[30] Foreign Application Priority Data

Nov. 30, 1989 [JP] Japan ..... 1-313682
Nov. 30, 1989 [JP] Japan ..... 1-313683
Nov. 30, 1989 [JP] Japan ..... 1-313684

[51] Int. Cl.[5] ..... B22D 27/02; B22D 11/124
[52] U.S. Cl. ..... 164/502; 164/443
[58] Field of Search ..... 164/466, 467, 502, 503, 164/443, 485, 439, 437, 488, 490, 440

[56] References Cited

U.S. PATENT DOCUMENTS 4,414,285 11/1983 Lowry et al. ..... 164/467
4,865,116 9/1989 Peterson et al. ..... 164/466

FOREIGN PATENT DOCUMENTS 62-227551 10/1987 Japan ..... 164/490
2132925 7/1984 United Kingdom .

OTHER PUBLICATIONS

"Aufwartsstranggie Ben edelmatallhaltiger Legierungen" by Dr.-Ing. G. Ogiermann and Dipl.-Ing. R. Emmerich, Degussa AG, Hanau -METALL- 40 Jahrgang-Heft 1-Jan. 1986.

*Primary Examiner*—Kuang Y. Lin
*Attorney, Agent, or Firm*—Ratner & Prestia

[57] ABSTRACT

An electromagnetic levitation type continuous metal casting apparatus is disclosed, which comprises a molten metal storing furnace for holding and storing a molten metal, a casting vessel for upwardly receiving and holding the molten metal in the form of an upwardly moving molten metal column, cooling means unified with the casting vessel and disposed around the outer periphery of the casting vessel for cooling and solidifying the upwardly moving molten metal column alternating electromagnetic levitation and containment field generation means unified with the casting vessel and disposed around the outer periphery thereof for generating an alternating electromagnetic levitation and containment field, the alternating electromagnetic field electro-magnetically levitation and containment the upwardly moving molten metal column while it is in the casting vessel, a tube shaped molten metal supply path for supplying the molten metal to be cast from the molten metal storing furnace to the casting vessel, and high frequency heating means disposed on the outer periphery of the tube shaped molten metal supply path, means are provided in the coolant path wherein the direction of flow of the coolant in the cooling means is inverted at the area where the second coil from the lower end of a plurality of coils comprising the generating means for generating the alternating electromagnetic levitating and containment field, is disposed, the tube shaped molten metal supply path having at a bend section upwardly to the casting vessel and an appendix section secured to the casting vessel on the side thereof opposed to the molten metal storing furnace.

2 Claims, 5 Drawing Sheets

ELECTROMAGNETIC LEVITATION TYPE CONTINUOUS METAL CASTING

This application is a continuation of application Ser. No. 07/619,866, filed Nov. 29, 1990 now abandoned.

BACKGROUND OF THE INVENTION

1. Field of the Invention

The present invention relates to an improved electromagnetic levitation type continuous metal casting apparatus.

2. Description of the Related Art

Conventionally, wires and rods composed of Al or Cu are produced by a continuous metal casting method as disclosed in U.S. Pat. No. 4,414,285. In this method, molten metal in a column shape is upwardly supplied to an upper casting or forming area. Thereafter, the molten metal column is exposed to an alternating electromagnetic levitation and containment field while being moved upwardly in the casting or forming area by withdrawal rolls. Simultaneously, the molten metal column is successively cooled and solidified, and the solidified metal product thereafter is removed from the top of the casting or forming area This electromagnetic levitation type continuous metal casting method has been practically used as an industrially effective means. According to the aforementioned electromagnetic levitation type continuous metal casting method, molten metal column to be cast or formed can be readily removed free from frictional forces and bonding forces against the sides of a casting vessel (mold) because the aforementioned alternating electromagnetic levitation and containment field produces a gravity free state referred to as "pressureless contact". In addition, in such a method, while the molten metal column passes through the alternating electromagnetic field, the inside of the molten metal column is stirred and thereby high homogeneity can be accomplished.

As an apparatus using the aforementioned continuous metal casting method as shown by a sectional view of FIG. 1 has been known. This apparatus comprises a molten metal storing furnace 2 for storing and holding a molten metal 1, a tube shaped casting vessel 3 vertically disposed for receiving the molten metal in the form of a column so as to solidify the molten metal 1, a heat exchange means 4 unified with the casting vessel 3 for cooling and solidifying the molten metal column received into the casting vessel 3, an alternating electromagnetic field generation means 5 composed of a plurality of layers of coils and disposed on almost all the periphery of the casting vessel 3 for generating the alternating electromagnetic levitation and containment field that acts on the upwardly moving the molten metal column, a means 6 such as withdrawal rolls for removing the solidified metal product which has been cooled and solidified from the top of the casting vessel 3, a molten metal supplying path 7 (named a rounder tube) for upwardly supplying the molten metal to be cast from the molten metal storing furnace 2 into the casting vessel 3, the molten metal supplying path 7 being a graphite tube with a high frequency heating means 8 disposed on the periphery thereof, and a liquid level adjusting unit 9 for adjusting the liquid level of the molten metal 1.

However, in the aforementioned electromagnetic levitation type continuous metal casting method, there are following problems to be solved.

As one of the problems, since the molten metal supplying path 7 for upwardly supplying the molten metal 1 to be cast from the molten metal storing furnace 2 into the casting vessel 3 should successively supply the molten metal 1 while keeping it in a particular molten state, the graphite pipe with high conductivity is used and the high frequency heating means 8 is disposed on the periphery thereof. However, the molten metal supply path 7 extends through the casting vessel 3 which is vertically disposed. At a bend section (elbow section) 7*a*, it is difficult to accomplish enough turns of a coil structuring the high, frequency heating means 8. Thus, the molten metal 1 cannot be always kept in the particular molten state. In other words, when the molten metal is supplied at a relatively low speed so as to perform a low speed casting operation, since the molten metal being supplied is solidified or cooled at the bend section 7*a*, the required amount of the molten metal 1 cannot be continuously supplied. Thus, in the molten metal supplying path 7, an improvement of the apparatus for continuously supplying the molten metal 1 has been required.

As the second problem, in the electromagnetic levitation type continuous metal casting apparatus in the aforementioned structure, as shown in FIG. 2 which is an enlarged sectional view of the principal portions of the casting vessel of FIG. 1, the casting vessel 3, the heat exchange means 4, and the alternating electromagnetic field generation means 5 are unified. In other words, on the outer periphery of the tube shaped casting vessel 3 with a fire proof layer 3*a* such as a graphite liner or the like disposed on the inner wall thereof, a flow path of a coolant (heat exchange means) is unified. In addition, in the full length of the outer periphery of the flow path of the coolant (heat exchange means) 4, a plurality of electromagnetic levitation coils (alternating electromagnetic field generation means) 5 are disposed. In such a structure, the first cooling point becomes a bottom plate 4*a* of the heat exchange means 4. When the alternating electromagnetic field generation means 5 is composed of six layers of coils 5*a*, required strength of the levitation electromagnetic field is obtained in the area of the second layer from both the ends thereof.

However, in the aforementioned electromagnetic levitation type continuous metal casting apparatus, there is the following problem. The molten metal column supplied upwardly from the molten metal storing furnace 2 for storing the molten metal 1 into the lower side of the casting vessel 3 through the molten metal supplying path 7 is cooled and solidified by the heat exchange means 4. At that time, the molten metal column is electromagnetically and upwardly levitated by the alternating electromagnetic field generation means 5 and then desired cast products, such as, wires are continuously produced. Thus, break aparts of the wire often take place. Such break aparts result from the fact that part of molten metal column supplied upwardly to the casting vessel 3 is solidified in the area or the lower area of a coil 5*a*1 which is the first layer from the bottom of the alternating electromagnetic field generation means 5, namely the area where levitating force and inwardly directed containment force cannot be satisfactorily obtained. Thus, the molten metal column is in contact with the wall of the casting vessel 3, thereby disturbing smooth upward movement of the molten metal column. To solve such a problem, in the wall area of the casting vessel 3 according to the coils 5*a*1 and the coil 5*a*2 which are respectively the first layer and the second layer from the bottom, a ceramic tube 3*b* is disposed, an air gap being disposed on the wall of the casting vessel 3 so as to decrease.. the thermal conductivity. However, in the aforementioned structure, the problem has not been solved.

The third problem is with respect to the molten metal supply path. As shown in FIG. 3, an apparatus with a displacer 9 has been used, the displacer 9 pressing the molten metal 1 in the molten metal storing furnace 2 so a to supply the molten metal 1 in the molten metal storing furnace 2 to the casting vessel 3 through the molten metal supply path 7. The molten metal supply path 7 is connected to a side wall in the vicinity of the bottom of the molten metal storing furnace 2. The molten metal supplying path 7 is composed of a horizontal section 7*a*, a vertical section 7*b*, and connection bend section 7*c* for connecting them. In this case, the molten metal supplying path 7 for upwardly supplying the molten metal 1 to be cast from the molten metal storing furnace 2 into the casting vessel 3 is generally composed of a graphite tube with high thermal conductivity and a heating means using high frequency heating method or the like, the heating means being disposed on the outer periphery of the graphite tube. The graphite tube is structured so that the molten metal supplying path 7 is easily oxidized and worn out by oxygen in the air or the molten metal 1. Namely, the durability of the graphite tube is low. Thus, since there are many joints between the horizontal section 7*a* and the molten metal storing furnace 2, between the horizontal section 7*a* and the vertical section 7*b* and between the vertical section 7*b* and the connection bend section 7*c*, the repair and replacement works become complicated. In addition, the possibility of leakage of the molten metal 1 increases. The possibility of the leakage of the molten metal at such joints is increased further by the hydrostatic pressure produced by the molten metal 1 during the required casting operation. In addition, in repairing and replacing the cooling means 4, the molten metal 1 in the molten metal storing furnace 2 should be removed or collected. This wastes the raw materials and increases the cost of the products. Therefore, an object of the present invention is to provide an electromagnetic levitation type continuous metal casting apparatus for decreasing or preventing the leakage of the molten metal 1 from the molten metal supplying path 7, the electromagnetic levitation type metal casting apparatus being free of the requirement for both the complicated repair and replacement works of the molten metal supplying path 7 and the loss of the molten metal 1 in the supply path 7 the molten metal storing furnace 2.

SUMMARY OF THE INVENTION

The electromagnetic levitation continuous metal casting apparatus according to one aspect of the invention comprises a molten metal storing furnace for holding and storing a molten metal, a casting vessel for upwardly receiving and holding the molten metal in the form of a molten metal column, cooling means unified with the casting vessel and disposed on the outer periphery thereof for cooling and solidifying the molten metal column. The molten metal is moved upwardly by withdrawal rolls and downward pressure of the molten metal in the storing furnace 2 while it is being levitated and contained by the levitating containment effect of an alternating electromagnetic field. Alternating electromagnetic field generation means are unified with the casting vessel and disposed on the outer periphery thereof for generating the alternating electromagnetic levitating and containment field. The alternating electromagnetic levitating and containment field electromagnetically and levitates and contains the molten metal column received and held in the casting vessel. A tube shaped molten metal supply path is provided for supplying the molten metal to be cast from the molten metal storing furnace to the casting vessel. High frequency heating means are disposed on the outer periphery of the tube shaped molten metal supply path, and the tube shaped molten metal supply path comprises a horizontal section extended from the molten metal storing furnace and a vertical section disposed for upwardly supplying the molten metal into the casting vessel through a bend section. The bend section is provided with an appendix section horizontally disposed on an opposite side of the molten metal storing furnace and the appendix section has a high frequency heating means.

The electromagnetic levitation type continuous metal casting apparatus according to a second aspect of the invention comprises a molten metal storing furnace for holding and storing a molten metal. A casting vessel is vertically disposed for upwardly receiving the molten metal in the form of a molten metal column and cooling means are unified with the casting vessel and disposed around the outer periphery thereof. A coolant flows in the opposite direction of the moving direction of the molten metal column for cooling and solidifying the molten metal column. The molten metal column is moved upwardly by the effect of the downward pressure of the molten metal in the holding furnace and withdrawal rolls (not shown). An alternating electromagnetic levitation and containment field is provided by an alternating electromagnetic field generation means unified with the casting vessel and disposed on the outer periphery thereof for generating the alternating electromagnetic levitating and containment field. The alternating levitation and containment field electromagnetically levitates and contains the upwardly moving molten metal column received and held in the casting vessel. The alternating electromagnetic levitation and containment field generation means is composed of a plurality of electromagnetic coils disposed on the outer periphery of the casting vessel. A tube shaped molten metal supply path is provided for upwardly supplying the molten metal to be cast from the molten metal storing furnace into the casting vessel. High frequency heating means are disposed around the outer periphery of the tube shaped molten metal supply path. Cooling means are provided for causing coolant to flow in the opposite direction of the moving direction of the molten metal column and is structured so that the flow of the coolant is inverted in an area adjoining the second electromagnetic coil from the lower end of the plurality of electromagnetic coils.

The electromagnetic levitation type continuous metal apparatus according to a third feature of the invention comprises a molten metal storing furnace for holding and storing a molten metal, a casting vessel vertically disposed for upwardly receiving and holding the molten metal in the form of a molten metal column. Cooling means are unified with the casting vessel and disposed around the outer periphery thereof for cooling and solidifying the molten metal column. The molten metal column is upwardly moved by the combined effect of gravity on the molten metal in the storing tank and withdrawal rolls. An alternating electromagnetic levitating and containment field is produced by alternating electromagnetic field generation means unified with the casting vessel and disposed around the outer periphery thereof for generating the alternating electromagnetic levitation and containment field. The alternating electromagnetic levitation and containment field electromagnetically levitates and contains upwardly moving molten metal column received and held in the casting vessel. A tube shaped molten metal supply path is provided for upwardly supplying molten metal to be cast from the molten metal storing furnace into the casting vessel. High frequency heating means are disposed around the outer periphery of the tube shaped molten metal supply path, and a displacer for pressuring the molten metal in the molten metal storing furnace is provided for supplying the molten metal into the casting furnace through the molten metal supply path. The molten metal supply path is extruded substantially horizontally from a side wall of the molten metal storing furnace with the extruded position of the side wall being higher than the liquid surface of the molten metal while the displacer is raised above the molten metal in the molten metal storing furnace. The extruded portion of the side wall is directly connected to the casting vessel with slight vertical section and without a connection section.

DESCRIPTION OF THE PREFERRED EMBODIMENTS

Then, by referring to the accompanying drawings, preferred embodiments of the present invention will be described.

Figure 4:
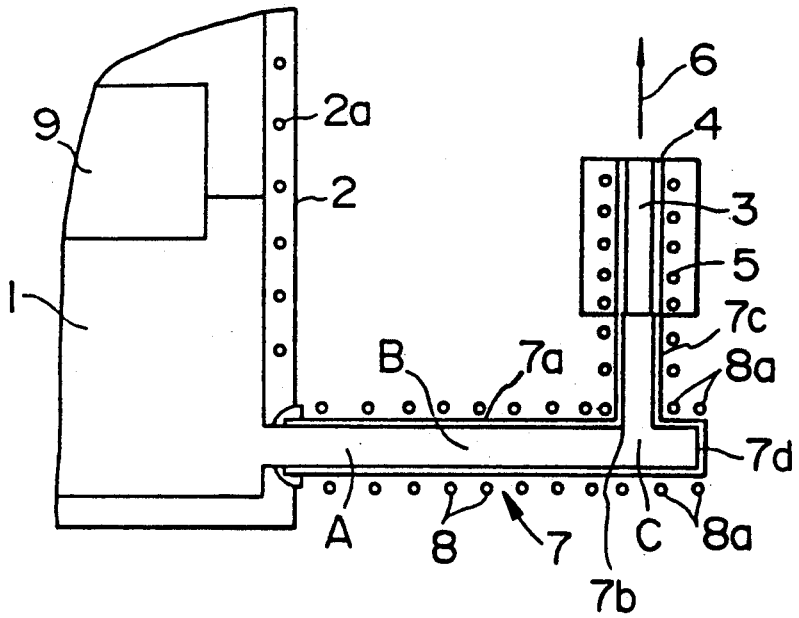
FIG. 4 is a sectional view showing the structure of the principal portions of an electromagnetic levitation continuous metal casting apparatus according to a principal feature of the present invention.

FIG. 4 is a sectional view showing the structure of the principal portions of an electromagnetic levitation type continuous metal casting apparatus according to the first feature of the invention. In the figure, the reference numeral 2 is the molten metal storing furnace for holding and storing the molten metal 1. Reference numeral 3 is the casting vessel for receiving and holding the molten metal 1 in the form of a molten metal column from the bottom thereof. Reference numeral 5 is the alternating electromagnetic levitating and containment field generation means unified with the casting vessel 3 and disposed on the outer periphery thereof for generating an electromagnetic field for electromagnetically levitating and containing the molten metal column which is received and held in the casting vessel 3. Reference numeral 4 is the cooling means unified with the casting vessel 3 and disposed around the outer peripheral thereof for cooling and solidifying the molten metal column which is received and held in the casting vessel 3 and which is upwardly moved by the pressure applied by a displacer member 9 and withdrawal rolls (not shown) while being levitated and contained by alternating electromagnetic field generation means 5, as explained in U.S. Pat. No. 4,414,285, for example. The cooling means 4 is a cooling water path and the reference numeral 7 is the tube shaped molten metal supplying path for upwardly supply the molten metal 1 to be cast from the molten metal storing furnace 2 into the casting vessel 3. The reference numeral 8 is the high frequency heating means disposed on the outer periphery of the molten metal supply path 7. In FIG. 4, the reference numeral 2*a* is a high frequency heating means for keeping the molten metal 1 stored in the molten metal storing furnace 2 in the molten state and the reference numeral 9 is a liquid surface adjusting displacer member.

In the electromagnetic levitation type continuous metal casting apparatus according to FIG. 4, an appendix section 7*b* is provided with a high frequency heating means 8*a* at the bend section 7*a* upwardly extended from the molten metal supply path 7. In other words, according to the present invention, the electromagnetic levitation type continuous metal casting apparatus is provided with the appendix section 7*b* having a high frequency heating means 8*a* at the bend section (elbow section) 7*a* of the molten metal supply path 7 named a rounder tube for supplying the molten metal 1 to be cast from the molten metal storing furnace 2 to the casting vessel 3 named a levitator, the appendix section 7*b* being extended from and unified with furnace 2 and supply path 7.

In the electromagnetic levitation type continuous metal casting apparatus, the tube shaped molten metal supply path 7 and the appendix section 7*b* are made of a fire proof ceramic with electric conductivity. Examples of fire proof ceramics with electric conductivity are boron type ceramics such as $TiB_2$, $ZrB_2$, $HfB_2$, $MoB_2$, $CrB_2$, etc, nitride type ceramics such as TiN, ZrN, NbN, VN, etc, and carbide type ceramics such as ZrC, HfC, VC, TiC, etc. The extended length of the appendix section 7*b* is determined by considering the material, length, diameter, and so forth of the molten metal supply path 7. In other words, the extended length is set to the length where the high frequency coil 8*a* can be wound at the bend section 7*a* of the molten metal supplying path 7 so that the appendix section 7*b* can supply heat enough to prevent the molten metal 1 from being solidified at the bent section 7*a*.

Figure 1:
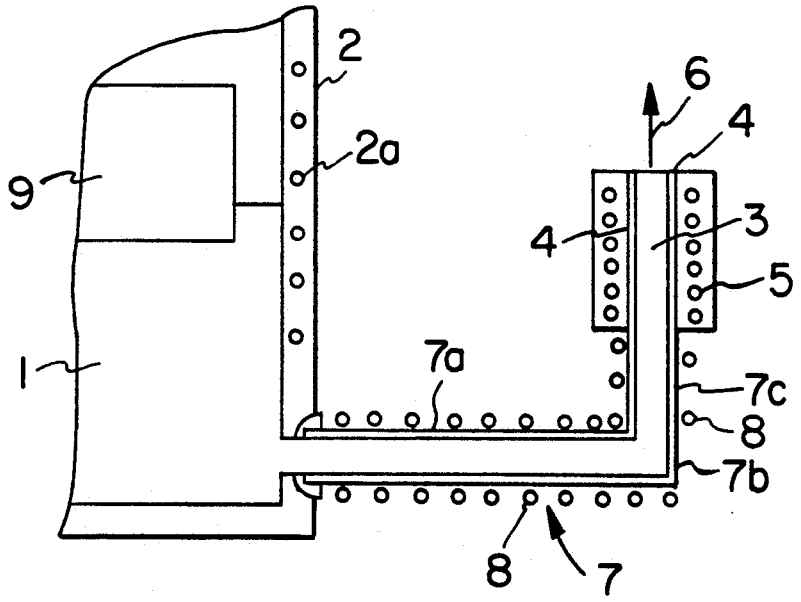
FIG. 1 PRIOR ART
FIG. 1 is a sectional view of the principal portions of a conventional electromagnetic levitation type continuous metal casting apparatus.
Figure 2:
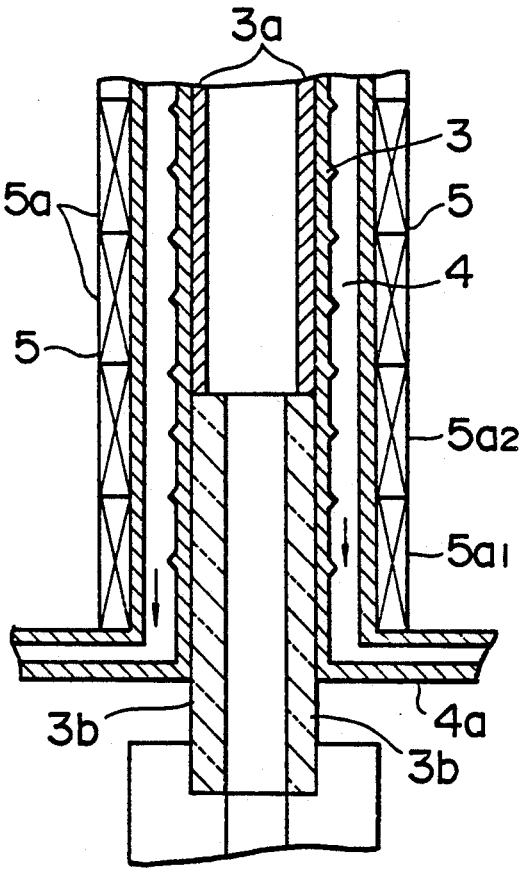
FIG. 2 PRIOR ART
FIG. 2 is an enlarged sectional view of the principal portions of a casting vessel of the electromagnetic levitation type continuous metal casting apparatus shown in FIG. 1.
Figure 3:
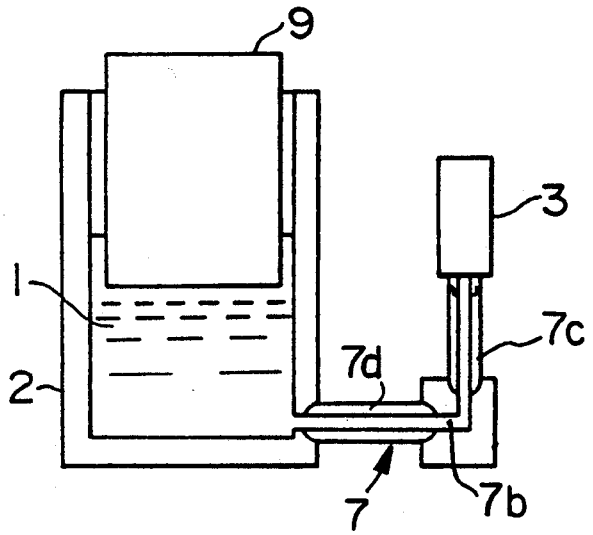
FIG. 3 PRIOR ART
FIG. 3 is an outlined sectional view showing an apparatus for supplying molten metal to be cast from a molten metal storing furnace provided with a displacer to a casting vessel through a molten metal supply path comprising the structure of the principal portions of the conventional electromagnetic levitation type continuous metal casting apparatus.

A copper wire was continuously cast by using the electromagnetic levitation type continuous metal casting apparatus according to the present invention. In FIG. 4 the tube shaped molten metal supply path 7 is composed of a graphite tube, the bend section 7*a* being provided with the appendix section 7*b* having the high frequency heating means 8*a*. TABLE 1 shows the result of measurement of temperatures of molten metal at points A and B of the molten metal supply path 7 and point C of the bend section 7a shown in FIG. 4. In the table, the temperatures at points A and B of the molten metal supplying path 7 and point C of the bend section 7a of the conventional electromagnetic levitation type continuous metal casting apparatus (FIG. 1) are also shown so as to compare the temperatures between the electromagnetic levitation type continuous metal casting apparatus according to the present invention and the related art.

TABLE 1

| | POINT A | POINT B | POINT C |
|---|---|---|---|
| EMBODIMENT | 1121° C. | 1177° C. | 1161° C. |
| PRIOR ART | — | 1176° C. | 958° C. |

As shown in the above table, in the case of the conventional electromagnetic levitation type continuous metal casting apparatus, the molten metal 1 supplied through the molten metal supply path 7 is cooled and freezes at the bend section 7a of the molten metal supply path 7 and thereby the flow of the molten metal 1 is stopped. On the other hand, in the case of the electromagnetic levitation type continuous metal casting apparatus according to FIG. 4 of the present invention, the molten metal 1 which is supplied through the molten metal supply path 7 is kept at high temperature even at the bend section 7a of the molten metal supplying path 7 and thereby a high fluidity is obtained. In addition, when the molten metal supply path 7 is made of a ceramic with electric conductivity, it is possible to prevent the molten metal 1 from being contaminated and the molten metal supply path 7 from getting worn by the molten metal 1.

As was described above, according to the electromagnetic levitation type continuous metal casting apparatus of the present invention, in the molten metal supply path 7 for supplying the molten metal 1 to be cast from the molten metal storing furnace 2 to the casting vessel 3, the temperature of the molten metal 1 can be maintained over almost the entire area of the molten metal supply path 7. Thus, the molten metal 1 is smoothly supplied to the casting vessel 3 with nearly even fluidity over the entire area of the molten metal supplying path 7. Consequently, even when a wire material is continuously cast at low speed, high quality products with equal sections and no breakage can be readily provided.

Figure 5:
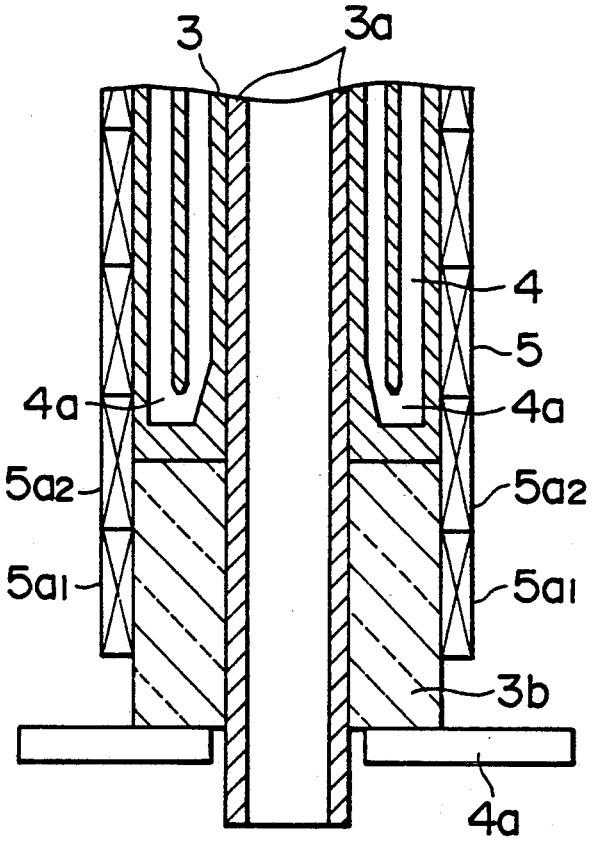
FIG. 5 is an enlarged sectional view showing the principal portions of the casting vessel according to a second feature of the present invention.

The basic structure of an electromagnetic levitation type continuous metal casting apparatus according to a second feature of the invention is similar to that shown in FIG. 4. The electromagnetic levitation type continuous metal casting apparatus according to the second feature is shown in FIG. 5 and comprises a molten metal storing furnace 2 (not shown) for holding and storing molten metal and supplying the same to casting vessel 3 for upwardly receiving and holding the molten metal 1 in the form of molten metal column. The molten metal is cast in a predetermined size by use of an alternating electromagnetic field generation means 5 unified with the casting vessel 3 and disposed around the outer periphery thereof for generating an alternating electromagnetic field so as to electromagnetically levitate and maintain the upwardly moving molten metal column while it is received and held in the casting vessel 3. The alternating electromagnetic field generation means 5 is comprised of a plurality of layers of coils 5a1, 5a2, etc. The heat exchange means 4 is unified with the casting vessel 3 and is disposed around the outer periphery thereof for causing a coolant to flow in the opposite direction of the molten metal column which is received and held in the casting vessel 3 and upwardly moved as described earlier. During this period the alternating electromagnetic levitating and containment field maintains the molten metal levitated against the force of gravity and contained out of pressure contact with the walls of casting vessel 3 in a "pressureless contact" condition as explained in U.S. Pat. No. 4,414,285 so to cool and solidify the molten metal column. The tube shaped molten metal supply path 7 for upwardly supplying the molten metal 1 to be cast from the molten metal storing furnace 2 into the casting vessel 3, and the high frequency heating means 8 disposed around the outer periphery of the tube shaped molten metal supply path 7, also are not shown in FIG. 5.

The heat exchange means 4 according to the second feature of the invention is structured as shown in FIG. 5 which is an enlarged sectional view. The heat exchange means 4 is unified with the casting vessel 3 and disposed around the outer periphery thereof. The casting vessel 3 is provided with a graphite liner layer 3a around the inner wall surface thereof and has its outer walls in contact with heat exchanger 4 in which, the flow of the coolant is inverted therein. Electromagnetic levitation coils 5a1 and 5a2 of the alternating electromagnetic levitation and containment field generation means 5 are are extended so as to be disposed over the outer periphery of the flow path of the coolant within heat exchange means 4, namely the area where the flow of the coolant is inverted. The area of the alternating electromagnetic field generation means 5 is wider than that of the cooling means 4 so that on the inside of the electromagnetic levitation coils 5a1 and 5a2 the alternating electromagnetic levitating and containment field generation means 5 are structured to extend more downwardly than the area of the cooling means 4. A thick solid wall ceramic tube section 3b is part of the casting vessel 3 structure and is disposed below and supports heat exchange means 4. In more detail, the heat exchange means 4 is structured by a dual pipe portion 4a so as to invert the flow of the coolant. At the portion 4a where the flow of the coolant is inverted, the electromagnetic levitation coil 5a2, which is the second layer from the lower end of the plurality of coils 5a1, 5a2, etc. comprising the alternating electromagnetic levitation and containment field generation means 5, is disposed.

In use the electromagnetic levitation type continuous metal casting apparatus in the aforementioned FIG. 5 structure, used in conjunction with a molten metal supply path 7 composed of a graphite tube as disclosed with relation to FIG. 4, a copper wire was continuously cast. As the result, a good wire product free of breakage and voids could be obtained. Since the construction of the cooling mechanism (heat exchange means 4) and the position of the alternating electromagnetic field generation coil 5a2 against the cooling mechanism 4a is structured as described above, the solidification of the molten metal column starts at an area where the levitating force satisfactorily acts on the molten metal column. In other words, the molten metal column is solidified while the molten metal column is both levitated and contained and is in a "pressureless contact" condition whereby the casting vessel is not contacted with a continuous contact pressure. In addition, the molten metal is solidified while it is satisfactorily levitated and stirred. Thus, according to the aforementioned electromagnetic levitation type continuous metal casting apparatus, even in a continuous metal casting process or the like, cast products free of breakage reliably can be obtained.

In the aforementioned structure, by providing the alternating electromagnetic field generation means 5 so that it can be moved relative to the cooling means 4 and unified with the casting vessel 3 and disposed around the outer periphery thereof, various types of products can be cast.

In the present embodiment, a graphite tube was used as the tube shaped molten metal supply path 7. However, in this embodiment, other electroconductive ceramics exemplified in the description of FIG. 4 can be used.

Figure 6:
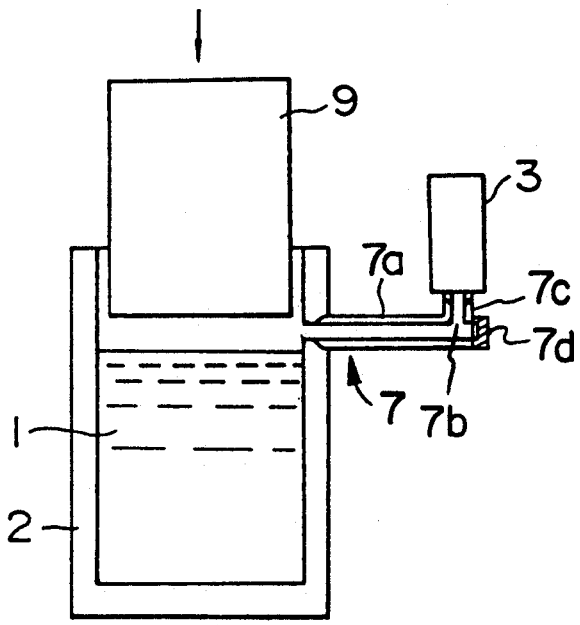
FIGS. 6 and 7 are sectional views showing the structure of the principal portions of an electromagnetic levitation type continuous metal casting apparatus according to a third feature of the present invention.

As shown by the outlined sectional view of FIG. 6, the electromagnetic levitation type continuous metal casting apparatus according to a third feature of the invention comprises the molten metal storing furnace 2 for holding and storing the molten metal 1, a tube shaped supply path 7 connected to a side surface of the molten metal storing furnace 2, and the casting vessel 3 for upwardly receiving and holding the molten metal 1 to be cast in the form of a molten metal column through the tube shaped molten metal supply path 7 and for casting it in a predetermined size. The casting vessel 3 also is provided with an alternating electromagnetic field generation means (not shown) unified with and disposed around the outer periphery thereof for generating an alternating electromagnetic levitating and containment field so as to electromagnetically levitate and contain the upwardly moving the molten metal column which is received and held in the casting vessel 3. The alternating electromagnetic field generation means is composed of a plurality of layers of coils, and the cooling means unified with the casting vessel 3 and disposed on the outer periphery thereof for cooling and solidifying the molten metal column as described earlier with respect to FIG. 5. The tube shaped molten metal supply path 7 is provided with a high frequency heating means disposed around the outer periphery thereof as described earlier with relation to FIG. 4. In addition, the molten metal storing furnace 2 is provided with a displacer 9 for pressuring the molten metal 1 which is held in furnace 2 and for supplying the molten metal 1 into the casting vessel 3 through the supply path 7.

As shown in FIG. 6, when the displacer 9 is raised from the molten metal which is held in the molten metal storing furnace 2, the tube shaped molten metal supply path 7 which projects nearly horizontally from the side wall of the molten metal storing furnace 2, and the projecting position of the path 7 is substantially level with the top of the liquid surface of the molten metal 1 in furnace 2. The vertical section **7*b* connected to the casting vessel 3 is structured with as short length as possible. The molten metal storing furnace 2** is provided with a high frequency heating means on the peripheral wall thereof (not shown) so as to keep the molten metal in molten state.

Figure 7:
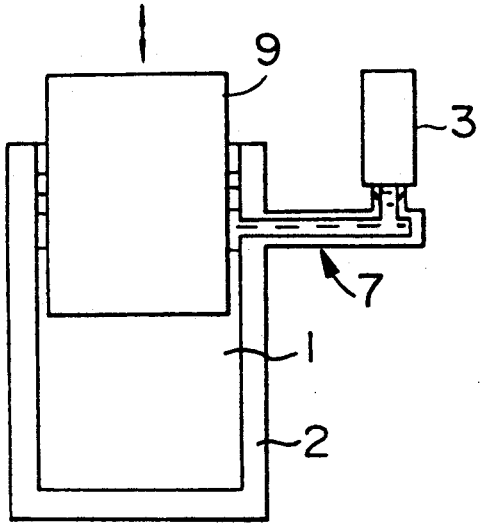

With reference to FIG. 7, the operation and usage of the electromagnetic levitation type continuous metal casting apparatus according to a third feature of the invention will be described. The molten metal storing furnace 2, the casting vessel 3, and the molten metal supplying path 7 are prepared and set so as to perform a particular continuous metal casting operation. Thereafter, the displacer 9 is driven so that the alternating electromagnetic field generation means 5 as shown in FIG. 5 is gradually submerged in the molten metal 1 supplied to casting vessel 3 from storing furnace 2 by supply pipe 7. By the submerging operation of the displacer 9, the liquid surface of the molten metal 1 is gradually raised. The raised molten metal is supplied to the casting vessel 3 through the molten metal supply path 7 so as to perform the electromagnetic levitation type continuous metal casting operation described in U.S. Pat. No. 4,414,285. When the displacer 9 is lifted up at the end of or to stop the casting operation, the liquid surface of the molten metal 1 in the molten metal storing furnace 2 drops, and the molten metal 1 in the molten metal supply path 7 and any molten metal in casting vessel flows back into the molten metal storing furnace 2 and is collected therein.

As was described above, when a particular continuous metal casting operation is stopped, since the application of the hydrostatic pressure by the molten metal 1 to the joints of the molten metal supplying path 4 and the like can be completely prevented, the problem of leakage of the molten metal 1 is solved. On the other hand, with respect to the maintenance of the molten metal supply path 7, since the molten metal 1 is collected to the molten metal storing furnace 2 and the molten metal supply path 7 inlet is disposed at a relatively high position relative to the top surface of the molten metal in storing furnace 2, it is not necessary to remove the molten metal 1 since it will be maintained in a molten state by the furnace.

As was described above, according to the electromagnetic levitation type continuous metal casting apparatus according to the present invention, when the casting operation is stopped, since the molten metal supply path system for supplying the molten metal to be cast from the molten metal storing furnace to the casting vessel does not store the molten metal, the maintenance of the molten metal supply path becomes easy. In addition, since the molten metal supply path does not have an intermediate connecting section, the probability of leakage of molten metal is reduced. In other words, when the casting operation is stopped, since the hydrostatic pressure by the molten metal is not applied to the molten metal supply path system, the probability of leakage from joints is reduced. Moreover, when the molten metal supply path is restarted, the disposal of the molten metal in the molten metal storing path is not required. Consequently, according to the electromagnetic levitation type continuous metal casting apparatus of the present invention, many advantages such as safe operation, easy maintenance, and high efficiency of molten metal in use can be practically obtained.

Having described one embodiment of a new and improved electromagnetic levitation type continuous metal casting apparatus according to the invention, it is believed obvious that other modifications and variations of the invention will be suggested to those skilled in the art in the light of the above teachings. It is therefore to be understood that changes may be made in the particular embodiment of the invention described which are within the full intended scope of the invention as defined by the appended claims.

What is claimed is:

1. An electromagnetic levitation type continuous metal casting apparatus comprising:

a molten metal storing furnace for holding and storing a molten metal;

a casting vessel vertically disposed for upwardly receiving said molten metal in the form of an upwardly moving molten metal column;

cooling means unified with said casting vessel and disposed around the outer periphery thereof for causing a coolant to flow in the opposite direction of the moving direction of said molten metal column and for cooling and solidifying said molten metal column;

alternating electromagnetic levitation and containment field generation means unified with said casting vessel and disposed around the outer periphery thereof for generating said alternating electromagnetic levitation and containment field, said alternating electromagnetic field serving to electromagnetically levitate and contain said upwardly moving molten metal column within said casting vessel, said alternating electromagnetic levitation and containment field generation means including a plurality of electromagnetic coils disposed around the outer periphery of said casting vessel;

a tube shaped molten metal supply path for upwardly supplying said molten metal to be cast from said molten metal storing furnace into said casting vessel; and high frequency heating means disposed on the outer periphery of said tube shaped molten metal supply path;

wherein said cooling means is designed for causing said coolant to flow in the opposite direction of the moving direction of said molten metal column with the direction of flow of said coolant being inverted in an area adjacent to the second electromagnetic coil from the lower end of said plurality of electromagnetic coils.

2. The electromagnetic levitation type continuous metal casting apparatus as set forth in claim 1, wherein said cooling means includes a divided dual pipe for performing the inversion in the direction of flow of said coolant.

* * * * *

UNITED STATES PATENT AND TRADEMARK OFFICE

CERTIFICATE OF CORRECTION

PATENT NO. : 5,244,034

DATED : September 14, 1993

INVENTOR(S) : Masahiko Yamada, Yuji Harada, Hidemi Shigetoyo

It is certified that error appears in the above-indentified patent and that said Letters Patent is hereby corrected as shown below:

On the Title Page, Item [57];

Abstract, line 15, delete "levitation and containment" and insert --levitating and containing--;
Abstract, line 28, delete "at" after "having";
Column 1, line 20, delete "while being" and insert --and--;
Column 1, line 21, delete "by with-";
Column 1, line 22, delete "drawal rolls";
Column 1, line 25, insert --.-- after "area";
Column 1, line 54, delete "that acts on the" and insert --which--, delete "moving" and insert --moves--;
Column 1, line 55, delete "such as withdrawal rolls";
Column 2, line 12, delete the comma after "high";
Column 3, line 3, delete periods after "decrease";
Column 3, line 10, delete "a" and insert --as--;
Column 3, line 50, insert --from-- after "path 7";
Column 3, line 62, insert --which is upwardly moved by the effect of an alternating electromagnetic field, and alternating-- after "column" and delete ". The molten metal is moved upwardly by";
Column 3, delete lines 63-65;
Column 3, line 66, delete "alternating electromagnetic field. Alternating";
Column 3, line 67, delete "are";
Column 4, line 4, delete "and" before "levitates";
Column 4, line 30, delete "The molten metal column is";
Column 4, delete lines 31 and 32;
Column 4, line 33, delete "withdrawal rolls (not shown).";
Column 4, line 65, delete "The molten metal";
Column 4, delete lines 66 and 67;
Column 4, line 68, delete "withdrawal rolls.";
Column 6, line 11, delete "pressure applied";
Column 6, delete line 12;
Column 6, line 13, delete "shown) while being levitated and contained by";
Column 6, line 14, delete ", as ex-";
Column 6, line 15, delete "plained in U.S. Pat. No. 4,414,285, for example";

UNITED STATES PATENT AND TRADEMARK OFFICE

CERTIFICATE OF CORRECTION

PATENT NO. :5,244,034

DATED :September 14, 1993

INVENTOR(S) :Masahiko Yamada, Yuji Harada, Hidemi Shigetoyo

It is certified that error appears in the above-indentified patent and that said Letters Patent is hereby corrected as shown below:

Column 6, line 18, delete "supply" and insert --supplying--;
Column 6, line 59, delete "bent" and insert --bend--;
Column 8, line 28, delete "are";
Column 8, line 49, delete "use";
Column 9, line 31, delete "the" after "moving";
Column 9, line 51, delete "position" and insert --portion--;
Column 9, line 54, insert --a-- after "short";
Column 9, line 58, insert --a-- after "in";
Column 10, line 13, insert --3-- after "vessel";
Column 10, line 18, delete "4" and insert --7--; and
Column 10, line 23, delete "to" and insert --back into--.
Abstract, line 9, insert --,-- between "column" and "alternat-";
Column 1, line 40, delete "As an" and insert --An--;
Column 1, line 68, insert --the-- after "are";
Column 2, line 13, delete "be always" and insert --always be--;
Column 2, line 54, delete "such as, wires" and insert --such as wires,--;

UNITED STATES PATENT AND TRADEMARK OFFICE

CERTIFICATE OF CORRECTION

PATENT NO. : 5,244,034

DATED : September 14, 1993

INVENTOR(S) : Masahiko Yamada, Yuji Harada, Hidemi Shigetoyo

It is certified that error appears in the above-indentified patent and that said Letters Patent is hereby corrected as shown below:

Column 2, line 57, insert --the-- after "part of";
Column 3, line 22, insert --a-- after "using";
Column 4, line 53, delete "is" and insert --are--;
Column 4, line 60, delete "metal," and insert --metal and--;
Column 5, line 7, insert --the-- before "upwardly";
Column 5, line 25, insert --a-- after "with";
Column 6, line 49, insert --.-- after "etc";
Column 6, line 50, insert --.-- after "etc";
Column 7, line 57, insert --a-- after "of";
Column 8, line 24, delete "," after "which";
Column 8, line 25, delete "therein";
Column 9, line 34, delete comma after "coils";
Column 9, line 35, insert --is-- after "means";
Column 9, line 51, insert --,-- after "7"; and
Column 10, line 2, delete "pipe" and insert --path--.

Signed and Sealed this

Twelfth Day of July, 1994

Bruce Lehman

*Attest:*

BRUCE LEHMAN

*Attesting Officer*

*Commissioner of Patents and Trademarks*